US011122950B2

(12) United States Patent
Zhu

(10) Patent No.: US 11,122,950 B2
(45) Date of Patent: Sep. 21, 2021

(54) CLEANING ROBOT AND CLEANING ROBOT SYSTEM

(71) Applicant: MIDEA ROBOZONE TECHNOLOGY CO., LTD., Suzhou (CN)

(72) Inventor: Xiaogang Zhu, Suzhou (CN)

(73) Assignee: MIDEA ROBOZONE TECHNOLOGY CO., LTD., Suzhou (CN)

( * ) Notice: Subject to any disclaimer, the term of this patent is extended or adjusted under 35 U.S.C. 154(b) by 431 days.

(21) Appl. No.: 16/121,660

(22) Filed: Sep. 5, 2018

(65) Prior Publication Data

US 2019/0298137 A1 Oct. 3, 2019

Related U.S. Application Data

(63) Continuation of application No. PCT/CN2018/098035, filed on Aug. 1, 2018.

(30) Foreign Application Priority Data

Mar. 30, 2018 (CN) ..... 201820459461.9

(51) Int. Cl.
*A47L 11/40* (2006.01)
*A47L 9/28* (2006.01)

(52) U.S. Cl.
CPC ..... *A47L 11/4002* (2013.01); *A47L 9/2868* (2013.01); *A47L 11/4063* (2013.01); *A47L 2201/00* (2013.01)

(58) Field of Classification Search
CPC ..... A47L 2201/00
USPC ..... 348/143
See application file for complete search history.

(56) References Cited

U.S. PATENT DOCUMENTS

| | | | | |
|---|---|---|---|---|
| 7,446,813 | B2 * | 11/2008 | Nakamoto | H04N 5/2259 348/151 |
| 2006/0095158 | A1 * | 5/2006 | Lee | G05D 1/0022 700/245 |
| 2007/0100501 | A1 * | 5/2007 | Im | G05D 1/0246 700/259 |
| 2016/0279808 | A1 * | 9/2016 | Doughty | G01D 5/34738 |

FOREIGN PATENT DOCUMENTS

| | | | |
|---|---|---|---|
| CN | 104224052 | A | 12/2014 |
| CN | 204181560 | U | 3/2015 |
| CN | 105615778 | A | 6/2016 |
| CN | 205987070 | U | 2/2017 |
| CN | 108013833 | A | 5/2018 |
| CN | 108125627 | A | 6/2018 |
| CN | 108209748 | A | 6/2018 |
| CN | 108209749 | A | 6/2018 |
| JP | 2006061439 | A | 3/2006 |

* cited by examiner

*Primary Examiner* — Jeffery A Williams

(57) ABSTRACT

A cleaning robot includes a housing, a camera rotationally connected to the housing, and power component mounted on the housing. The power component includes a motor and a gear set, and is connected to the camera via the gear set, and the motor is configured to drive the camera to rotate around a rotation axis via the gear set. The present disclosure also provides a cleaning robot system.

14 Claims, 8 Drawing Sheets

CLEANING ROBOT AND CLEANING ROBOT SYSTEM

CROSS-REFERENCE TO RELATED APPLICATION

This application is a continuation of International Application No. PCT/CN2018/098035, filed Aug. 1, 2018, which claims priority to and benefits of Chinese Patent Application Serial No. 201820459461.9, filed with the State Intellectual Property Office of P. R. China on Mar. 30, 2018, the entire content of which is incorporated herein by reference.

FIELD

The present disclosure relates to the field of cleaning robot technology, and more particularly to a cleaning robot and a cleaning robot system.

BACKGROUND

In the related art, a cleaning robot includes a camera for capturing images. However, the camera has a small angle of view, leading to a poor user experience.

SUMMARY

Embodiments provide a cleaning robot and a cleaning robot system.

The cleaning robot according to Embodiments includes:

a housing;

a camera, rotationally connected to the housing; and a power component mounted on the housing, in which the power component includes a motor and a gear set and is connected to the camera via the gear set, and the motor is configured to drive the camera to rotate around a rotation axis via the gear set.

In the cleaning robot according to Embodiments, as the camera is rotationally connected relative to the housing, and the motor can drive the camera to rotate around the rotation axis via the gear set, so that an angle of view of the camera is enlarged, and the user experience is good.

The cleaning robot system according to Embodiments includes:

a housing;

a camera, rotationally connected to the housing;

a power component mounted on the housing, in which the power component includes a motor and a gear set and is connected to the camera via the gear set, and the motor is configured to drive the camera to rotate around a rotation axis via the gear set; and an electronic device, configured to control the camera to rotate.

In the cleaning robot system according to Embodiments, as the camera is rotationally connected relative to the housing, and the motor can drive the camera to rotate around the rotation axis via the gear set, so that an angle of view of the camera is enlarged, and the user experience is good.

Additional aspects and advantages of embodiments of present disclosure will be given in part in the following descriptions, become apparent in part from the following descriptions, or be learned from the practice of the Embodiments.

BRIEF DESCRIPTION OF THE DRAWINGS

These and/or other aspects and advantages of Embodiments will become apparent and more readily appreciated from the following descriptions made with reference to the drawings, in which.

DETAILED DESCRIPTION

Figure 1:
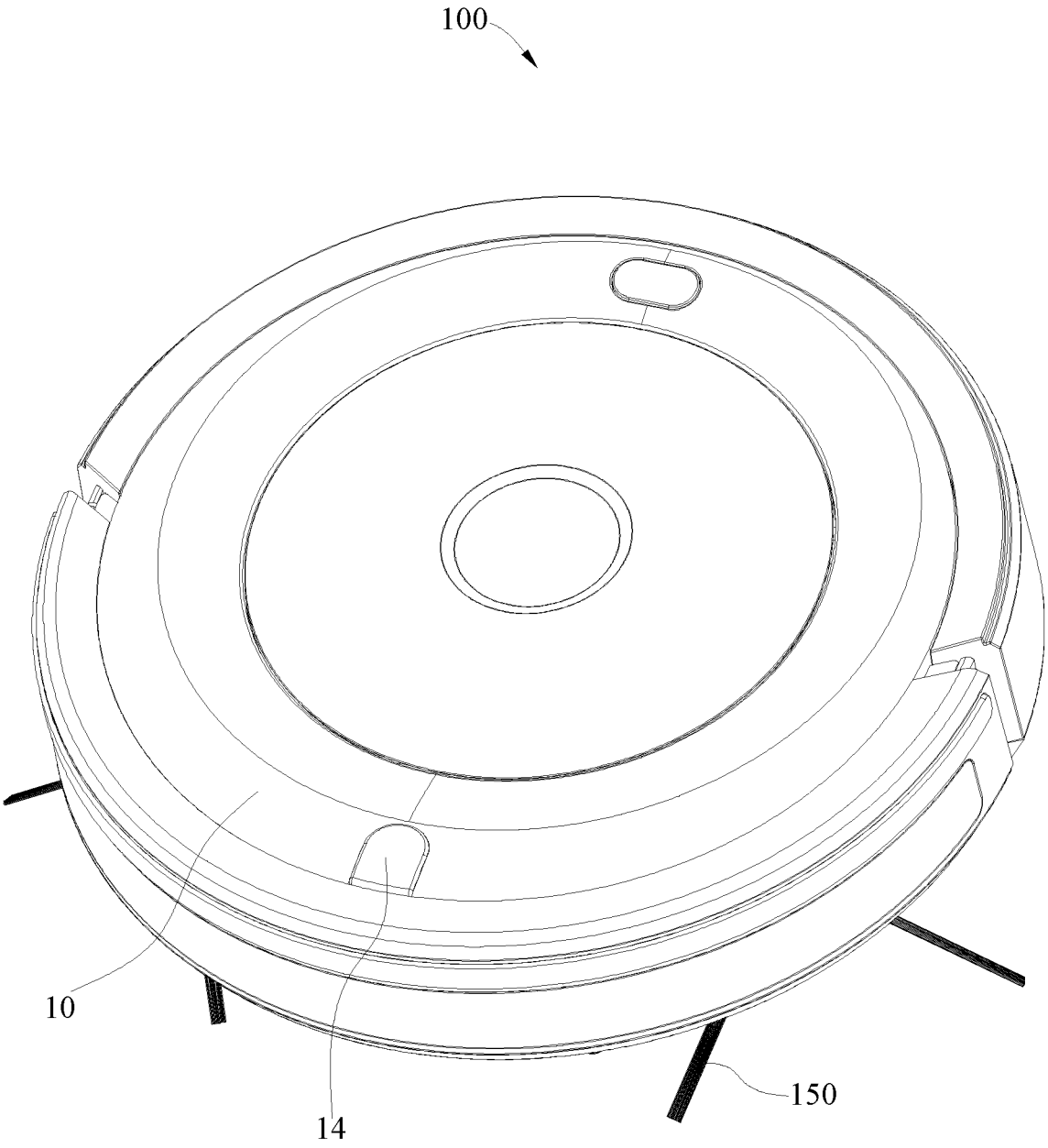
FIG. 1 is a schematic perspective view of a cleaning robot according to Embodiments.

Reference Numerals of Main Elements cleaning robot system 1000, cleaning robot 100, housing 10, through-hole 12, light-transmitting coverplate 14, camera 20, power component 30, bracket 40, through-hole 42, through-hole 44, transmission mechanism 50, transmission shaft 52, first interference segment 522, first interference segment 524, gear set 53, first gear 54, second gear 56, motor 60, first fastener 70, mounting base 80, circuit board 90, motor fixing mechanism 110, fixing pillar 112, arc support 114, motor fixing hoop 120, central hole 122, through-hole 124, second fastener 130, host circuit board 140, communication module 142, controller 144, side brush 150, electronic device 200.

Embodiments will be further described below with reference to the accompanying drawings, in which the same or similar elements and elements having same or similar functions are denoted by like reference numerals throughout the descriptions.

In addition, the embodiments described herein with reference to the accompanying drawings are explanatory, illustrative, and used to generally understand the present disclosure. The embodiments shall not be construed to limit the present disclosure.

In the present invention, unless specified or limited otherwise, a structure in which a first feature is "on" or "below" a second feature may include an embodiment in which the first feature is in direct contact with the second feature, and may also include an embodiment in which the first feature and the second feature are not in direct contact with each other, but are contacted via an additional feature formed therebetween. Furthermore, a first feature "on," "above," or "on top of" a second feature may include an embodiment in which the first feature is right or obliquely "on," "above," or "on top of" the second feature, or just means that the first feature is at a height higher than that of the second feature; while a first feature "below," "under," or "on bottom of" a second feature may include an embodiment in which the first feature is right or obliquely "below," "under," or "on bottom of" the second feature, or just means that the first feature is at a height lower than that of the second feature.

Referring to FIGS. 1 to 4, as shown, an example cleaning robot 100 in accordance with the disclosure may include a housing 10, a camera 20 and a power component 30. The camera 20 is rotationally connected to the housing 10. The power component 30 is mounted on the housing 10. The power component 30 includes a motor 60 and a gear set 53, and is connected to the camera 20 via the gear set 53. The motor 60 is configured to drive the camera 20 to rotate around a rotation axis L via the gear set 53.

In the cleaning robot 100 according to the above embodiments, as the camera 20 is rotationally connected to the housing 10, and the motor 60 can drive the camera 20 to rotate around the rotation axis L via the gear set 53, so that an angle of view of the camera 20 is enlarged, and the user experience is good.

It will be appreciated that, a rotation range of the camera 20 relative to the housing 10 may be accordingly set according to the angle of view required by the cleaning robot 100, which is not limited herein. In an embodiment, a rotation angle of the camera 20 is within 60 degrees. That is, a maximum rotation range of the camera 20 around the rotation axis L driven by the power component 30 is 60 degrees.

During the cleaning process of the cleaning robot 100, the camera 20 can be used to take pictures of the surrounding environment. Since the camera 20 can rotate, the angle of view of the camera 20 is enlarged, so that images of the environment in a larger area can be captured.

In some embodiments, the power component 30 may be an alternating current motor, a direct current motor or other electronic components capable of driving the camera 20 to rotate, which will not be restricted herein.

As the motor 60 rotates fast when starting, the gear set 53 according to embodiments slows a rotation speed of the camera 20 down, so as to protect the camera 20 and facilitate the camera 20 to capture images.

The housing 10 may be in a circular shape or a roughly square shape, and may be a plastic housing. A bumper (not shown in figures) may be disposed at a frond of the housing 10, and a spring may be disposed between the bumper and the housing 10 so as to buffer an impact force applied to the cleaning robot 100 by an obstacle when the housing 10 collides with the obstacle, thereby protecting the cleaning robot 100.

Figure 2:
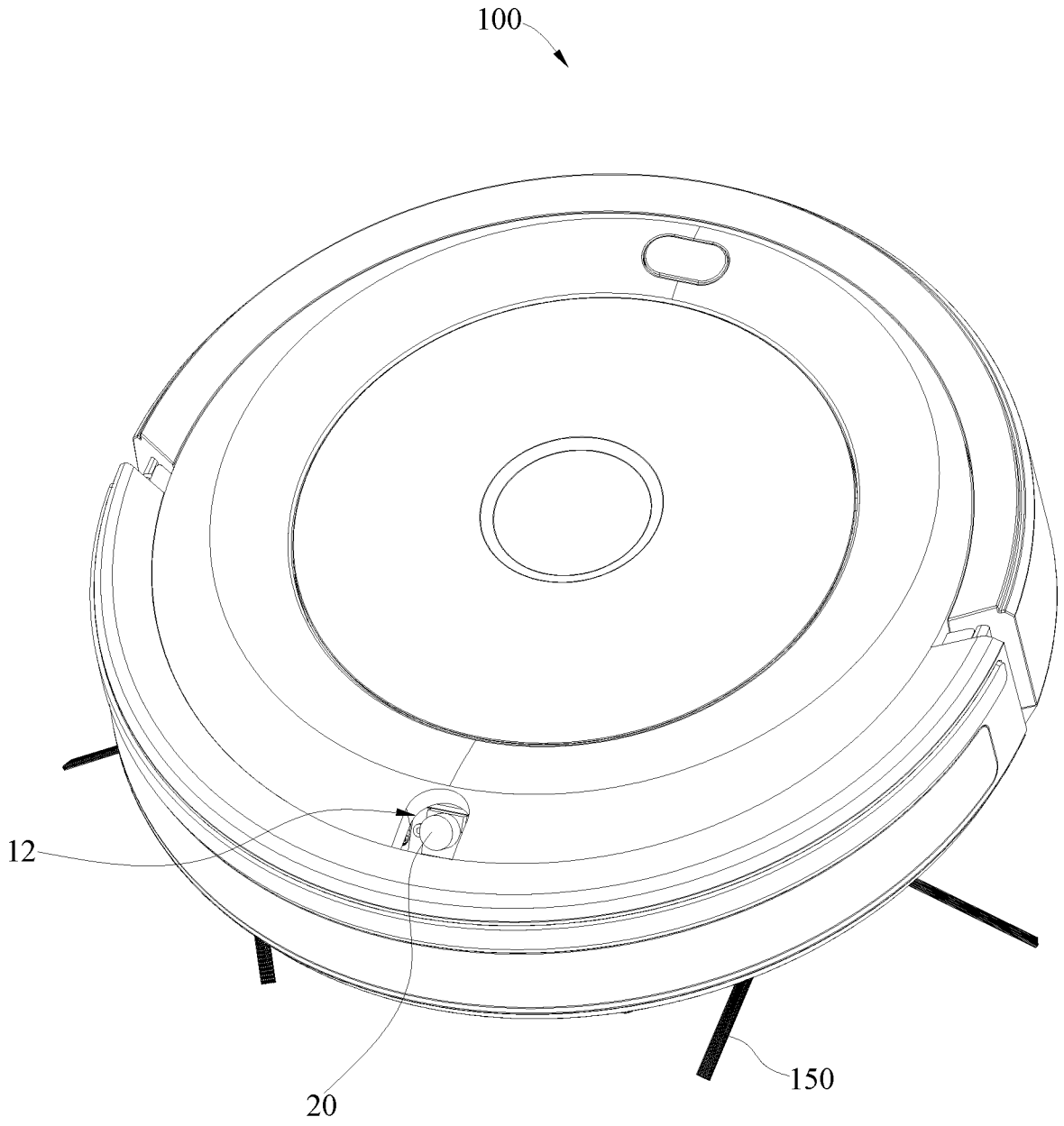
FIG. 2 is a schematic perspective view of a cleaning robot according to Embodiments.

Referring to FIG. 2, in some embodiments, the camera 20 is at least partially accommodated within the housing 10, and exposed through the housing 10. In this way, the housing 10 can protect the camera 20.

It will be appreciated that, the camera 20 is exposed through the housing 10. In an example, the housing 10 may define a through-hole 12, and the camera 20 is exposed through the through-hole 12 to capture images. In another example, the housing 10 may have a closed structure, and is transparent, so that the camera 20 can capture images through the transparent housing.

Referring to FIG. 2, in some embodiments, the housing 10 defines the through-hole 12, and the camera 20 is exposed through the through-hole 12. Thereby, the camera 20 can capture images through the through-hole 12, and the structure is simple.

Specifically, the through hole 12 may be in a circular, a square or an oval shape, which will not be restricted herein. A height of the camera 20 may be flush with the through-hole 12 or lower than the through-hole 12, which will not be restricted herein.

Referring to FIG. 1, in some embodiments, the cleaning robot 100 includes a light-transmitting coverplate 14 for covering the through-hole 12. In this way, the camera 20 can capture images through the light-transmitting coverplate 14, and the light-transmitting coverplate 14 for covering the through-hole 12 can prevent dusts from entering the camera 20.

In some embodiments, an area of the light-transmitting coverplate 14 may be consistent with that of the through-hole 12. In another embodiment, the area of the light-transmitting coverplate 14 may be larger than that of the through-hole 12, and the light-transmitting coverplate 14 may be attached to an outer edge of the through hole 12 through an adhesive.

Figure 3:
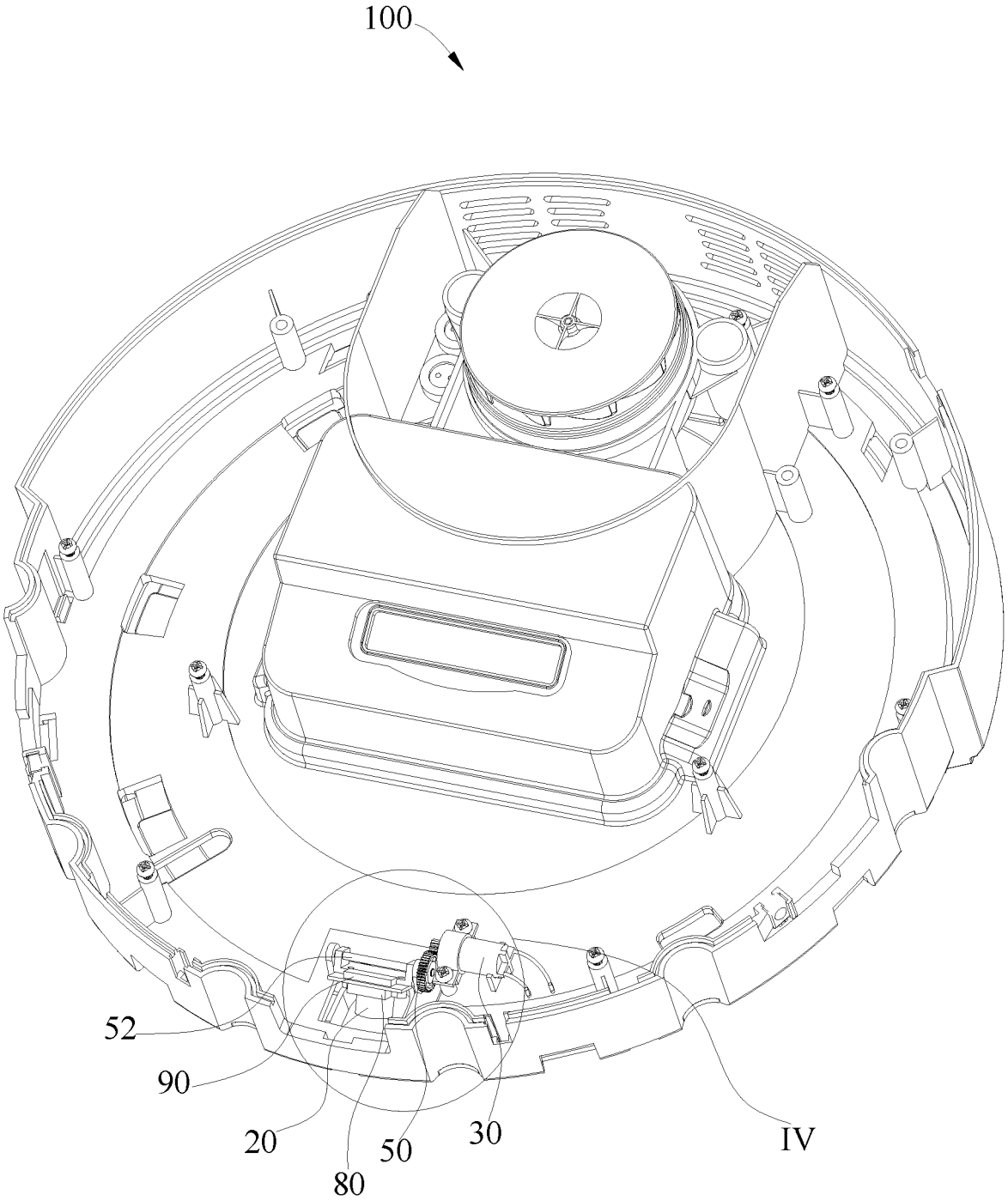
FIG. 3 is a schematic view showing an internal structure of a cleaning robot according to Embodiments.
Figure 4:
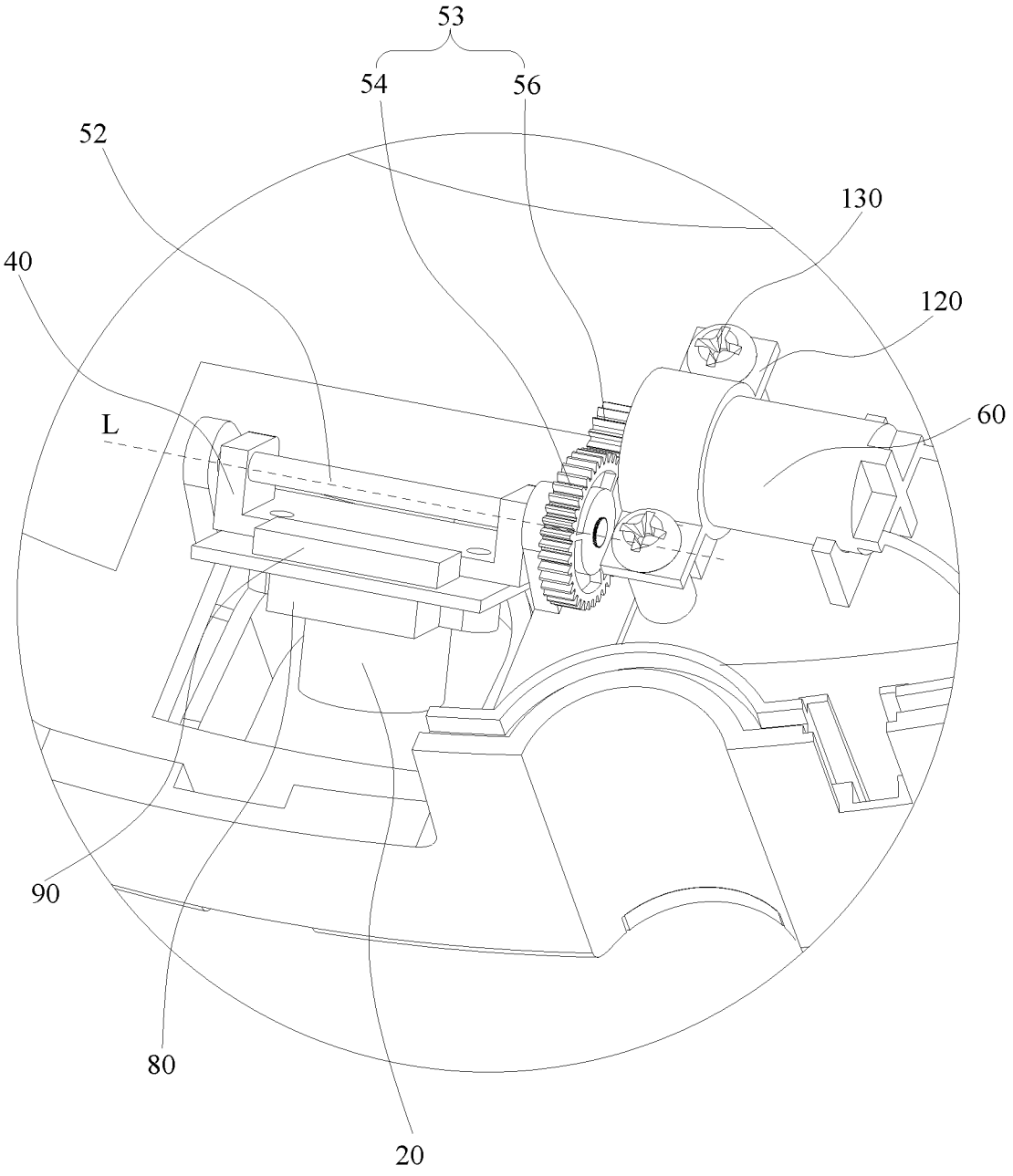
FIG. 4 is an enlarged view of part IV of the cleaning robot shown in FIG. 3.
Figure 5:
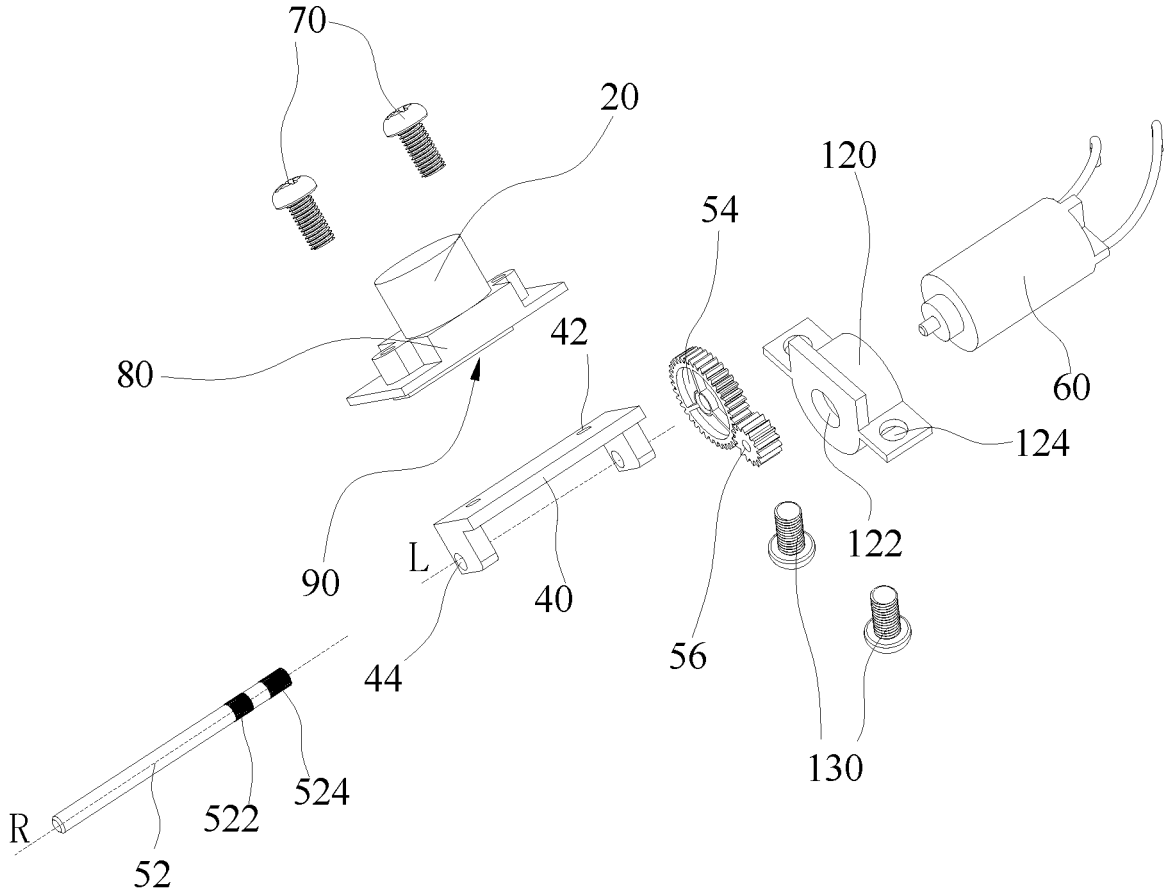
FIG. 5 is an explosive view of a cleaning robot according to Embodiments.

Referring to FIGS. 3 to 5, in some embodiments, the cleaning robot 100 includes a bracket 40 rotationally connected to the housing 10. The camera 40 is fixed to the bracket 40, and the gear set 53 is connected to the bracket 40.

In this way, the bracket 40 is driven to rotate via the transmission mechanism 50 so as to drive the camera 20 to rotate, which allows the cleaning robot 100 to have a simple structure, and makes the cleaning robot 100 lighten and thin.

In some embodiments, referring to FIG. 5, the bracket 40 defines a through-hole 42, the camera 20 may be fixed on the bracket 40 by screwing a first fastener 70 in the through-hole 42, and the first fastener 70 may be a screw. In another embodiment, the camera 20 may be fixed on the bracket 40 through the adhesive, which will not be restricted herein.

Though the motor 60 rotates fast, the transmission mechanism 50 connected to the motor 60 can play a deceleration effect. Thereby, when the motor 60 rotates, the rotation speed of the camera 20 can be correspondingly slowed down by using the transmission mechanism 50 to drive the rotation of the bracket 40, which is beneficial for the camera 20 to capture images.

It should be illustrated that, the transmission of the transmission mechanism 50 may be achieved using a transmission mode, including gears, belts and connecting rods.

Referring to FIGS. 3 to 5, in some embodiments, the cleaning robot 100 includes a mounting base 80 and a circuit board 90 stacked below the mounting base 80, and the camera 20 is fixed to the bracket 40 via the mounting base.

Therefore, the mounting base 80 can prevent the camera 20 from falling off. In addition, the circuit board 90 can receive the images captured by the camera 20 and process them accordingly.

In some embodiments, the first fastener 70 can pass through a through-hole of the mounting base 80 and the through-hole 42 of the bracket 40 so as to fix the mounting base 80 to the bracket 40. For example, the first fastener 70 may be a screw. In addition, the circuit board 90 is stacked between the mounting base 80 and the bracket 40, and the circuit board 90 is electrically connected to the camera 20.

Figure 6:
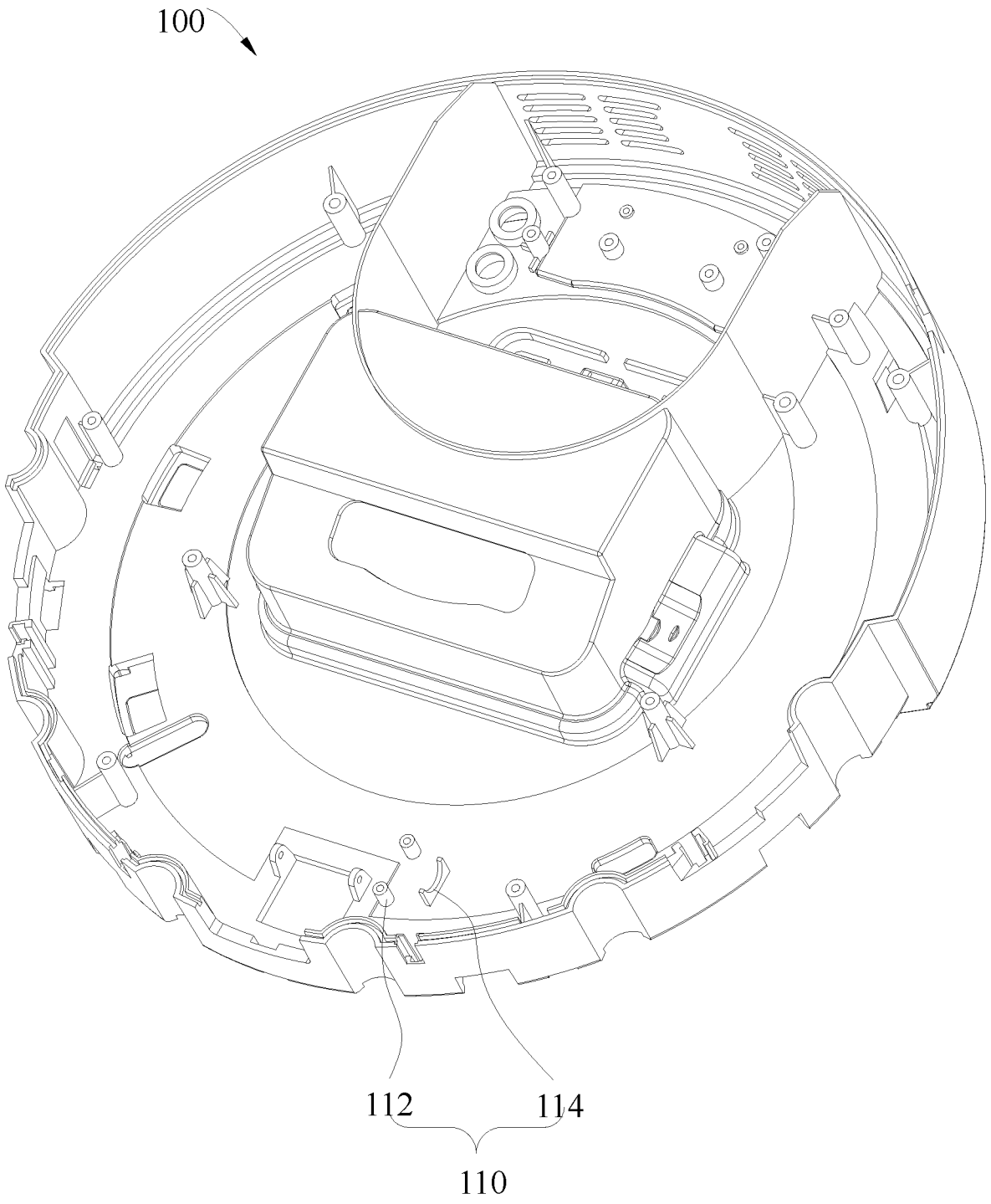
FIG. 6 is a schematic view showing an internal structure of a cleaning robot according to Embodiments.

Referring to FIG. 6, in some embodiments, the cleaning robot 100 includes a motor fixing mechanism 110 fixed on the housing 10, and the motor 60 is fixed on the motor fixing mechanism 110. In this way, the motor fixing mechanism 110 can preventing the motor 60 from sliding during rotation of the motor 60.

In some embodiments, the motor fixing mechanism 110 includes a fixing pillar 112 and an arc support 114, and a radian of the arc support 114 is matched with that of the motor 60 so that the motor 60 can be stably caught on the arc bracket 114.

Referring to FIGS. 3 to 5, in some embodiments, the transmission mechanism 50 includes a transmission shaft 52 inserted into the bracket 40, a first gear 54 and a second gear 56. An axis R of the transmission shaft 52 coincides with the rotation axis L. the gear set 53 includes a first gear 54 and a second gear 56. The first gear 54 is connected to an end of the transmission shaft 52. The second gear 56 is engaged with the first gear 54 and connected to the motor 60. A gear ratio between the first gear 54 and the second gear 56 is greater than 1.

In this way, a rotation speed of the bracket 40 driven by the motor 60 via the first gear 54 and the second gear 56 is slowed down, so as to protect the camera 20 and facilitate the camera 20 to capture images.

In some embodiments, the bracket 40 defines a through-hole 44, the transmission shaft 52 can be inserted into the through-hole 44, and an end of the transmission shaft 52 adjacent to the first gear 54 is connected to a central hole of the first gear 54. The cleaning robot 100 further includes a motor fixing hoop 120 and a second fastener 130, the motor 60 passes through a central hole 122 of the motor fixing hoop 120 to connect to the second gear 56, and the motor fixing hoop 120 can play a role in stabilizing the motor 60 during the rotation of the motor 60. Two lugs extending from two sides of the motor fixing hoop 120 each define a through-hole 124, and the second fastener 130 may pass through the through-hole 124 to insert into the fixing pillar 112. It will be appreciated that, the second fastener 130 may be a screw, and the fixing pillar 112 defines a groove matched with a thread of the screw.

Referring to FIG. 5, the transmission shaft 52 includes a first interference segment 522 and a second interference segment 524. An interference fit is established between the first interference segment 522 and the through-hole 42 adjacent to the first gear 54, and between the second interference segment 524 and the central hole of the first gear 54. The interference fit refers to such a tight connection that depends on an interference value between a shaft and a hole, so that an elastic pressure is generated between surfaces of for example the transmission shaft 52 and the through-hole 42 after they are assembled so as to achieve the tight connection therebetween.

It should be illustrated that, the fit connection between the transmission shaft 52 and the through-hole 42 and the connection between the transmission shaft 52 and the central hole of the first gear 54 may be achieved in other ways. For example, the transmission shaft 52 may be provided with a projection, a groove may be defined in an inner wall of the through-hole 42 adjacent to the first gear 54, and the projection may fit with the groove to achieve the connection therebetween.

It should be illustrated that, the gear ratio between the first gear 54 and the second gear 56 may be set according to an actual requirement, which will not be limited herein. In an example, the gear ratio between the first gear 54 and the second gear 56 may be 20.

Figure 7:
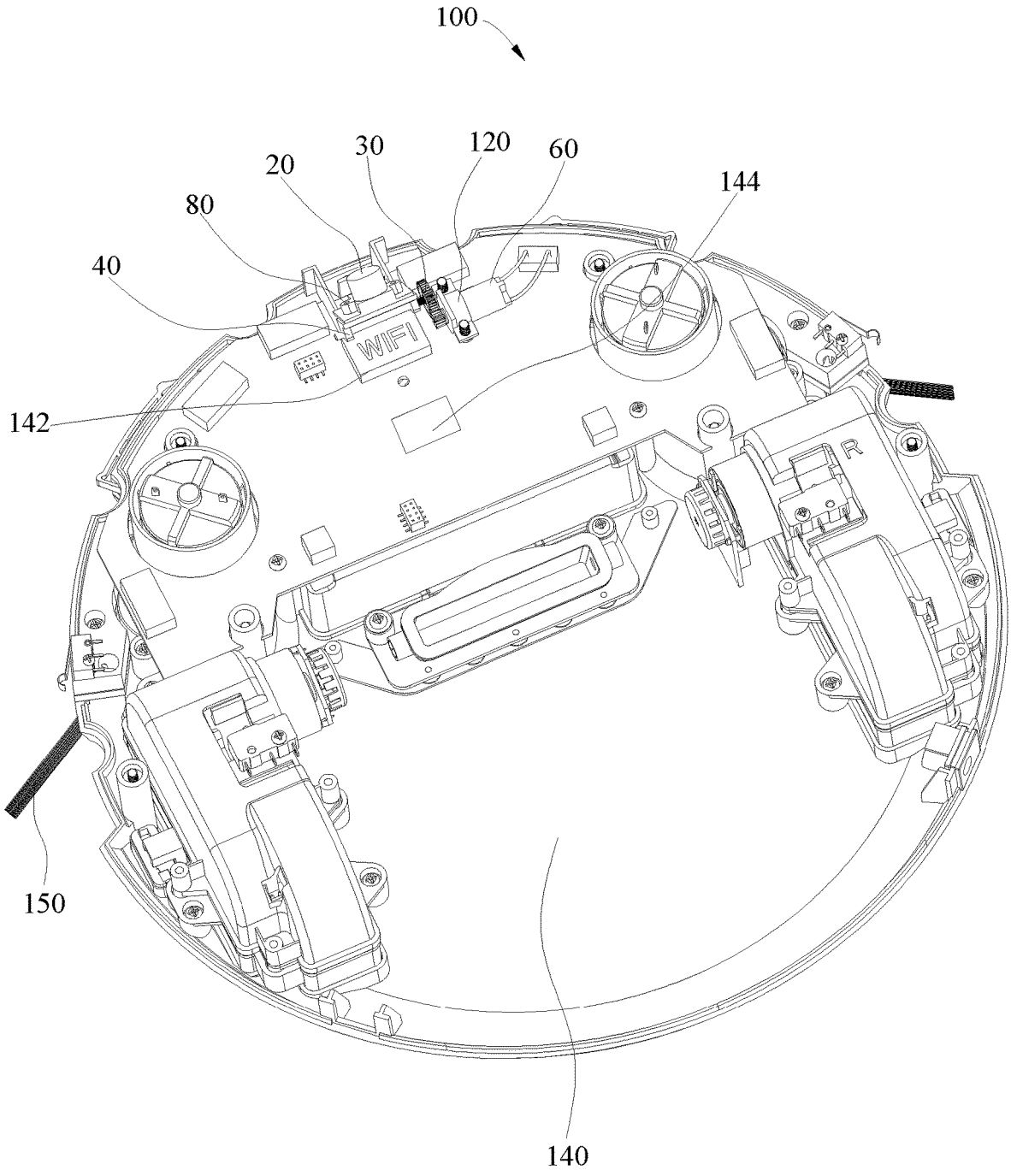
FIG. 7 is a schematic view showing an internal structure of a cleaning robot according to Embodiments.

Referring to FIG. 7, in some embodiments, the cleaning robot 100 includes a host circuit board 140, and the host circuit board 140 includes a communication module 142 and a controller 144. The communication module 142 is configured to receive a control signal from an electronic device 200. The controller 144 is configured to control the camera 20 to rotate according to the control signal.

In this way, a connection between the electronic device 200 and the cleaning robot 100 can be achieved, and a user can interact with the cleaning robot 100 via the electronic device 200.

In some embodiments, the electronic device 200 may be a mobile phone, and the mobile phone is installed with an APP that cooperates with a control program of the cleaning robot 100. The cleaning robot 100 may be paired with the mobile phone via the communication module 142. After the pairing is successful, the user can control the motor 60 to rotate via a program of the APP in the mobile phone, and the camera 20 will be driven to rotate after the speed is slowed down by the gear set. The communication module 132 is for example a WIFI communication module.

Figure 8:
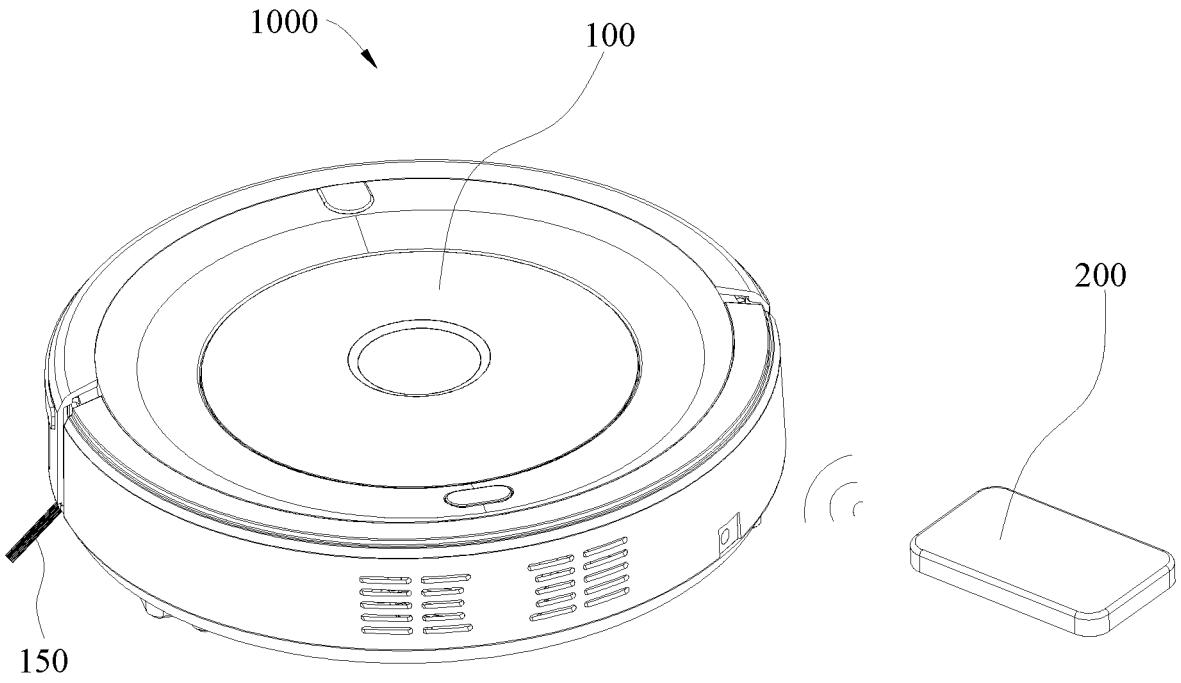
FIG. 8 is a schematic perspective view of a cleaning robot system according to Embodiments.

Referring to FIG. 8, Embodiments further provide a cleaning robot system 1000. The cleaning robot system 1000 includes the electronic device 200 and the cleaning robot 100 as described in any one of the embodiments hereinbefore. The electronic device 200 is configured to control the camera 20 to rotate.

In the cleaning robot system 1000 according to the disclosure, as the camera 20 is rotationally connected relative to the housing 10, and the motor 60 can drive the camera 20 to rotate around the rotation axis L via the gear set 53, so that an angle of view of the camera 20 is enlarged, and the user experience is good.

It should be illustrated that, the electronic device 200 includes, but is not limited to mobile phones, tablet computers, bracelets, etc. In an embodiment, the electronic device 200 may communicate with the cleaning robot 100 via wireless WIFI. In another embodiment, the electronic device 200 may communicate with the cleaning robot 100 via Bluetooth. It will be appreciated that the communication between the electronic device 200 and the cleaning robot 100 may be in other ways, which will not be limited herein.

Referring to FIG. 1 and FIG. 2, in an example, the housing 10 may be provided with a dust collecting cup (not shown in the figures) therein, and the dust collecting cup may have at least one layer of filtering structure. A suction inlet (not shown in the figures) is defined at a bottom of the housing 10, and the suction inlet can communicate with the dust collecting cup. At a rear side of the dust collecting cup, a dust collecting motor may be disposed for generating a negative pressure, under the action of which the dust can be sucked into the dust collecting cup from the suction inlet. After using the cleaning robot 100 for a certain period of time, the user can take the dust collecting cup out of the housing 10 of the cleaning robot 100 and discard the dust. In addition, the user can regularly clean the dust collecting cup and the filtering structure.

A traveling wheel (not shown in the figures) may be disposed at each of two sides of the dust collecting cup, and each traveling wheel may be separately driven by a motor (not shown in the figures). In addition, a universal wheel (not shown in the figures) with supporting and steering functions may also be disposed at a front of a middle position of the two traveling wheels, which will not be limited herein.

At the bottom of the housing 10 and at the front of the two traveling wheels, a side brush 150 may be disposed, which may be separately driven by a motor to rotate, and is capable of collecting dust at the bottom and two sides of the housing to the suction inlet, so that the dust can be inhaled into the dust collecting cup more efficiently.

Reference throughout this specification to "an embodiment," "some embodiments," "an example," "a specific example," or "some examples," means that a particular feature, structure, material, or characteristic described in connection with the embodiment or example is included in at least one embodiment or example of the present disclosure. Thus, the appearances of the phrases such as "in some embodiments," "in one embodiment", "in an embodiment", "in another example," "in an example," "in a specific example," or "in some examples," in various places throughout this specification are not necessarily referring to the same embodiment or example of the present disclosure. Furthermore, the particular features, structures, materials, or characteristics may be combined in any suitable manner in one or more embodiments or examples.

In addition, terms such as "first" and "second" are used herein for purposes of description and are not intended to indicate or imply relative importance or significance or to imply the number of indicated technical features. Thus, the feature defined with "first" and "second" may comprise one or more of this feature. In the description of the present invention, the phrase of "a plurality of" means two or more than two, for example, two or three, unless specified otherwise.

Although explanatory embodiments have been shown and described above, it would be appreciated by those skilled in the art that the above embodiments cannot be construed to limit the present disclosure, and changes, alternatives, and modifications can be made in the embodiments without departing from spirit, principles and scope of the present disclosure.

What is claimed is:

1. A cleaning robot, comprising:

a housing;

a camera, rotationally connected to the housing;

a power component mounted on the housing, wherein the power component comprises a motor and a gear set and is connected to the camera via the gear set, wherein the motor is configured to drive the camera to rotate around a rotation axis through a center of the gear set;

a host circuit board, the host circuit board comprising:

a communication module configured to receive, over a wireless link, a control signal from an electronic device, the control signal being generated by the electronic device according to a user input for controlling the a rotation of the camera;

a controller configured to control the camera to rotate around the rotation axis according to the control signal received from the electronic device; and a bracket rotationally connected to the housing, wherein the camera is fixed onto the bracket, and the gear set is connected to the bracket;

wherein the power component comprises a transmission shaft inserted into the bracket, an axis of the transmission shaft coincides with the rotation axis;

wherein the gear set comprises a first gear connected to an end of the transmission shaft and a second gear engaged with the first gear and connected to the motor, and a gear ratio between the first gear and the second gear is greater than 1.

2. The cleaning robot according to claim 1, wherein the camera is at least partially accommodated within the housing, and exposed through the housing.

3. The cleaning robot according to claim 2, wherein the housing defines a through-hole, and the camera is exposed through the through-hole.

4. The cleaning robot according to claim 3, further comprising a light-transmitting coverplate for covering the through-hole.

5. The cleaning robot according to claim 1, further comprising a mounting base and a circuit board stacked below the mounting base, the camera being fixed to the bracket through the mounting base.

6. The cleaning robot according to claim 1, further comprising a motor fixing mechanism fixed on the housing, wherein the motor is fixed on the motor fixing mechanism.

7. The cleaning robot according to claim 1, wherein the electronic device is a smartphone associated with a user, and wherein:

the communication module is further configured to receive an instruction to associate the robot cleaner with the smart phone; and the control module is further configured to associate the robot cleaner with the smart phone to enable the user to control robot cleaner.

8. A cleaning robot system, comprising:

a housing;

a camera, rotationally connected to the housing;

a power component mounted on the housing, wherein the power component comprises a motor and a gear set and is connected to the camera via the gear set, wherein the motor is configured to drive the camera to rotate around a rotation axis through a center of the gear set;

a bracket rotationally connected to the housing, wherein the camera is fixed to the bracket, and the gear set is connected to the bracket; and a host circuit board, the host circuit board comprising:

a communication module configured to receive, over a wireless link, a control signal from an electronic device, the control signal being generated by the electronic device according to a user input for controlling the a rotation of the camera; and a controller configured to control the camera to rotate around the rotation axis according to the control signal received from the electronic device;

wherein the power component comprises a transmission shaft inserted into the bracket, an axis of the transmission shaft coincides with the rotation axis;

wherein the gear set comprises a first gear connected to an end of the transmission shaft and a second gear engaged with the first gear and connected to the motor, and a gear ratio between the first gear and the second gear is greater than 1.

9. The cleaning robot system according to claim 8, wherein the camera is at least partially accommodated within the housing, and exposed through the housing.

10. The cleaning robot system according to claim 9, wherein the housing defines a through-hole, and the camera is exposed through the through-hole.

11. The cleaning robot system according to claim 10, further comprising a light-transmitting coverplate for covering the through-hole.

12. The cleaning robot system according to claim 8, further comprising a mounting base and a circuit board stacked below the mounting base, the camera being fixed to the bracket through the mounting base.

13. The cleaning robot system according to claim 8, further comprising a motor fixing mechanism fixed on the housing, wherein the motor is fixed on the motor fixing mechanism.

14. The cleaning robot system according to claim 8, further the electronic device is a smartphone associated with a user, and wherein:

the communication module is further configured to receive an instruction to associate the robot cleaner with the smart phone; and the control module is further configured to associate the robot cleaner with the smart phone to enable the user to control robot cleaner.

* * * * *